United States Patent [19]

McConnell

[11] Patent Number: 4,616,813

[45] Date of Patent: Oct. 14, 1986

[54] SUSPENSION FOR SURGICAL SUPPORT APPARATUS

[76] Inventor: Bernard E. McConnell, Rte. 2, Box 87, Greenville, Tex. 75401

[21] Appl. No.: 693,146

[22] Filed: Jan. 22, 1985

Related U.S. Application Data

[63] Continuation-in-part of Ser. No. 598,579, Apr. 10, 1984, Pat. No. 4,579,324.

[51] Int. Cl.[4] ..... A61G 13/00

[52] U.S. Cl. ..... 269/328

[58] Field of Search ..... 269/328, 45, 77, 79, 269/71; 5/503, 504, 507, 508; 128/84

[56] References Cited

U.S. PATENT DOCUMENTS

| | | | |
|---|---|---|---|
| 957,890 | 5/1910 | Krejci | 5/507 |
| 1,968,120 | 7/1934 | Barghausen et al. | 269/328 |
| 2,248,170 | 7/1941 | Hansen | 269/45 |
| 2,644,961 | 7/1953 | Hillenbrand et al. | 5/507 |
| 2,941,215 | 6/1960 | Johnson | 5/507 |
| 3,706,105 | 12/1972 | Nicholas et al. | 5/507 |
| 4,016,613 | 4/1977 | Benoit et al. | 5/508 |

FOREIGN PATENT DOCUMENTS

| | | | |
|---|---|---|---|
| 482548 | 6/1953 | Italy | 269/328 |

*Primary Examiner*—Robert C. Watson

*Attorney, Agent, or Firm*—Glaser, Griggs & Schwartz

[57] ABSTRACT

A suspension frame and clamp assembly for attaching surgical support apparatus onto an operating table is disclosed. The assembly includes a releasable clamp which allows the attachment part to be installed onto the side rail of an operating table or removed from the side rail at any intermediate side rail location. The suspension frame includes an elongated support tube or bar attached in such a manner that the support bar is offset laterally below the side rail and outside of the sterile field of the operating table. In a preferred embodiment, the suspension assembly includes parallel vertical struts which are rigidly attached at their lower ends to the horizontal support bar, and which are attached at their upper ends to a releasable clamp assembly. According to an alternate embodiment, the vertical support struts are releasably coupled to the horizontal support bar by a releasable box clamp. Transverse support struts provide additional stability.

12 Claims, 11 Drawing Figures

SUSPENSION FOR SURGICAL SUPPORT APPARATUS

CROSS-REFERENCE TO RELATED APPLICATION

This application is a continuation-in-part of U.S. Application Ser. No. 598,579 filed Apr. 10, 1984 now U.S. Pat. No. 4,579,324.

FIELD OF THE INVENTION

This invention relates generally to the art of suspension devices, and in particular to a suspension frame and clamp assembly for attaching surgical support apparatus onto an operating table.

BACKGROUND OF THE INVENTION

In the performance of orthopedic surgery and related procedures, it is often necessary to support a portion of the patient's body including one or more limbs in a fixed position during the procedure, and also to vary the position from time to time. In some cases, operating room personnel manually support the particular extremity and change the position of the extremity as desired. The use of operating room personnel to support a patient during a surgical procedure is unsatisfactory in that the assistant supporting the extremity may tire and find it necessary to change position at some critical or otherwise inconvenient time. Additionally, pillows and other padded devices have been used. Such devices often obstruct the performance of surgery or related procedures and usually cannot provide overhead support for slings, hooks and the like.

Accordingly, various mechanical devices have been constructed and utilized for supporting and positioning body portions including limbs during the performance of surgery on a portion of a limb itself or a connecting joint. Such mechanical devices are adapted for mounting onto an operating table or a free standing platform and generally include surgical support apparatus overlying the sterile zone of the operating table. Such equipment may be clamped onto the side rail of the operating table and moved about from time to time as required by the surgical procedure. Free standing support equipment is not in widespread use for orthopedic procedures because of the stability requirements of such procedures.

DESCRIPTION OF THE PRIOR ART

Operating tables are provided with side rails onto which surgical support equipment can be attached. However, the side rails are relatively small and are closely located to the sterile operating field. Certain support positions are difficult to achieve with support apparatus which is attached directly to the side rail. For example, the lower arm board is preferably mounted at table level and the lower element of certain hip positioning apparatus should also be supported near the surface of the operating table. Such support apparatus is preferably mounted in offset relation with respect to the operating table to provide for a wide range of support positions.

Moreover, certain universal positioning equipment must be manually released from time to time to reposition support devices such as slings and hooks which are suspended above the sterile operating zone. An example of such equipment is disclosed in claimed in my copending U.S. Application Ser. No. 598,579, filed Apr. 10, 1984, entitled "Universal Extremity Positioner" which is hereby incorporated by reference. In that arrangement the universal positioning apparatus has a footoperated release and is too large to be mounted directly onto the small side rail. Accordingly, it is designed to be mounted onto a large support bar which is suspended from the side rail. In that arrangement, the position of a sling or hook can be changed at will by pressing and releasing the foot lever.

Such equipment when mounted in or near the sterile operating zone must be sterilized before it is mounted onto the rail. Certain attachment devices cannot be sterilized effectively and therefore must be located in an area outside of the sterile field.

It will be appreciated that in surgical procedures, time is of the essence, and delays associated with adjustment of support equipment are unwanted. Additionally, the presence of surgical support equipment about the sterile operating area limits the surgeon's access to the patient during the procedure. Thus it is generally desirable to limit the number of surgical support devices in and around the sterile zone, so that the operating surgeon and his attendants will have clear and unrestricted access to the patient.

During certain procedures, it is desirable to impose or change a biasing force on a body portion or limb which is undergoing a surgical procedure or treatment. It is awkward or impossible in some instances to apply such bias forces through instruments or apparatus which are mounted directly onto the side rail. Thus it is desirable to offset such equipment both laterally and vertically in the regions immediately surrounding the operating table, including the side rail areas.

Accordingly, there is a specific need for surgical support apparatus which may be mounted onto an operating table outside of the sterile field, for suspending a limb support device above the operating surface of the table, with the limb supporting apparatus or the like being easily removed from the attachment part of the apparatus for sterilization, and which remains sterile during adjustment thereof.

SUMMARY OF THE INVENTION

The present invention provides an improved suspension frame and clamp assembly for attaching the surgical support apparatus onto an operating table, and includes releasable coupling means which allows the attachment part to be installed onto the side rail of an operating table or removed from the side rail at any intermediate side rail location. Additionally, the present invention includes an elongated support tube or bar attached to a supsension frame in such manner that the support bar is offset laterally and vertically below the side rail and sterile field of the operating table.

In accordance with the preferred embodiment of the present invention, the suspension assembly includes an improved clamp for releasably attaching vertical support struts onto the side rail of an operating table, the improved clamp including releasable coupling means which allows the clamp to be installed onto the side rail or removed from the side rail at intermediate locations without disturbing the established positions of other surgical support devices anchored to the same side rail. In the preferred embodiment, the improved clamp includes a clamp body having an attachment portion adapted for coupling engagement with surgical support apparatus, a fixed jaw member for engaging the upper portion of the side rail, a movable compression member for engaging the lower portion of the side rail, and driving means for moving the compression member to an open, retracted position allowing positioning of the jaw member and compression member about opposite sides of the rail, and to an extended position in which the compression member is urged against a lower edge portion of the side rail with the rail being confined and compressed between the fixed jaw and the compression member.

According to the foregoing arrangement, a compressive force is transmitted by the driving means through the compression member against the side rail which firmly anchors the clamp at any desired position along the rail. The clamp is removed from the rail simply by releasing the driving means to allow the compression member to be returned to its retracted position, whereupon the clamp assembly may be completely removed from the side rail without disturbing the established positions of other surgical support devices also attached to the rail.

According to another aspect of the invention, the compression member is mounted for pivotal movement within a locking cavity and includes a jaw portion and a cam portion. The jaw portion is adapted to engage an edge portion of the side rail, and the cam portion of the compression member is adapted to engage a turn screw. The turn screw is movable through a threaded bore which communicates with the locking cavity. As the turn screw is advanced into the cavity, it engages the cam surface of the compression member and drives its jaw portion into compressive engagement with the lower corner of the side rail. When removal of the clamp is desired, the turn screw is withdrawn from the cavity through the threaded bore, thereby allowing the compression member to rotate to its retracted, open jaw position.

According to yet another aspect of the invention, a horizontal support tube having a rectangular support section is connected to parallel vertical struts. According to one arrangement, the lower ends of the tubular struts are securely joined to the horizontal support tube at the lower ends of the tubes, while the upper ends of the tubes are joined by a horizontal brace. The upper ends of each support strut are joined to a releasable clamp assembly. According to this arrangement, the suspension assembly can be attached to the side rail of an operating table at any desired side rail locations which are unoccupied. Moreover, the utility support tube is suspended in offset relation and vertically beneath the side rails, thereby providing maximum access to the sterile field of the operating table.

According to another aspect of the improved suspension assembly, each support strut is coupled to the horizontal support tube by a hinged, box clamp assembly. In this arrangement, one side of a box clamp is hinged and can be opened to allow the box clamp to be inserted directly into the interior of the box clamp. After the horizontal support tube has been inserted, the hinged bottom plate is closed and clamped tightly about the horizontal support tube. The advantage of this arrangement is that a stable suspension frame including parallel support struts, a horizontal brace and a pair of releasable rail clamps can be rigidly attached to horizontal support tubes of various lengths needed to accomodate different surgical procedures.

The superior feature and advantages of the present invention will be further appreciated by those skilled in the art upon reading the detailed description which follows in conjunction with the attached drawings.

DETAILED DESCRIPTION OF THE PREFERRED EMBODIMENT

Figure 1:
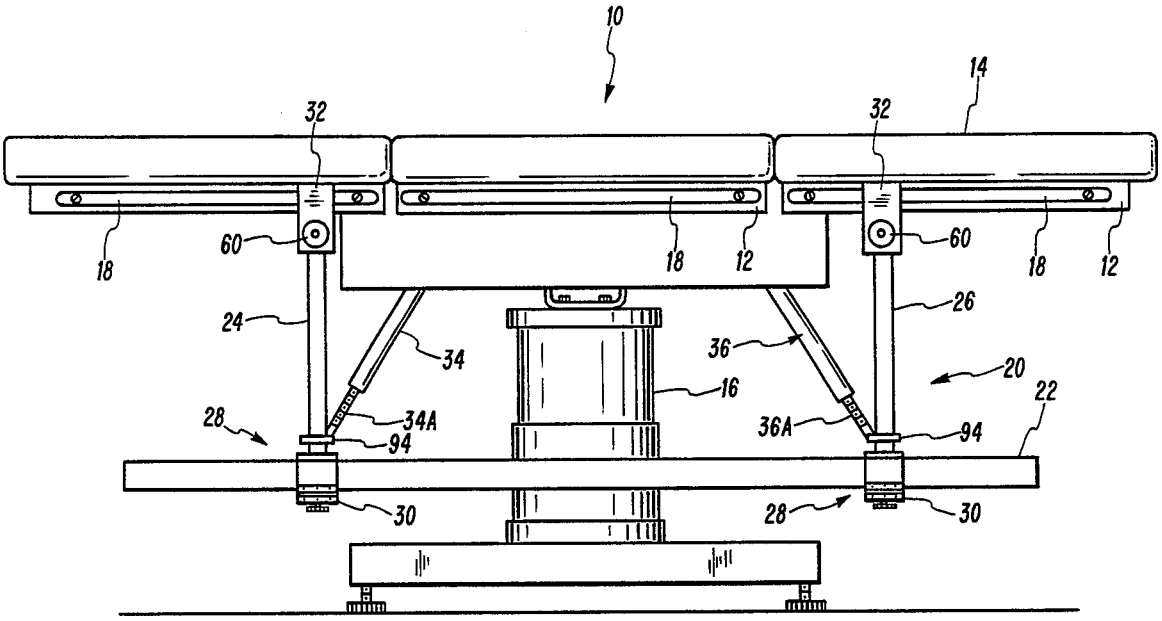
FIG. 1 is a longitudinal side elevation view of an operating table to which the suspension frame and clamp assembly of the invention is mounted.

In the description which follows, like parts are indicated throughout the specification and drawings with the same reference numerals, repsectively. The drawings are not necessarily to scale and certain parts have been exaggerated to better illustrated details of the present invention.

The improved suspension frame and clamp assembly of the present invention is particularly well-suited for use in connection with a conventional surgical operating table during the performance of orthopedic surgery or other medical procedures.

Figure 2:
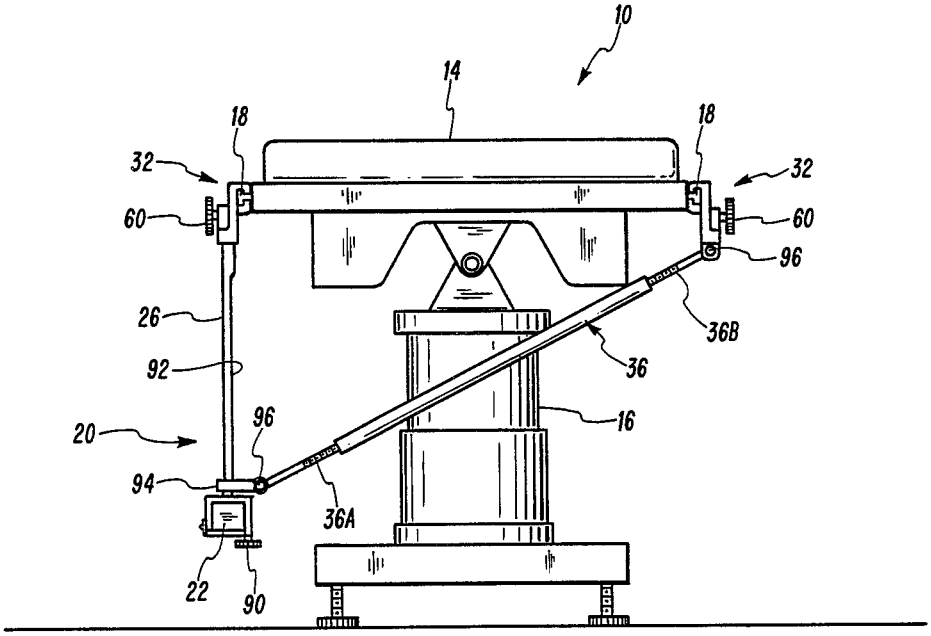
FIG. 2 is an end elevational view of the apparatus shown in FIG. 1.

Referring now to FIGS. 1 and 2 of the drawings, there is illustrated an operating table generally designated by the numeral 10 which includes a patient support table 12 and a sterile pad 14. The operating table 10 includes a base structure 16 which is capable of altering the position of the patient support table 12 to accomodate various surgical procedures. The table 10 also includes, along opposite longtudinal sides thereof, longitudinal support rails 18 which are rectangular in cross section and constructed of stainless steel. The side rails 18 appear as somewhat elongated flat metal bars which are mounted onto the table 12 and laterally spaced therefrom by pins 19.

Attached to the side rail 18 is a suspension assembly 20 having a horizontally disposed support bar 22. The support bar 22 is rectangular in cross section and may be solid or hollow, as desired. The support bar 22 is connected to a pair of vertical legs or struts 24, 26 the lower ends of which are clamped onto the support bar 22 by a removable clamp assembly 28. The clamp assembly 28 is a rectangular frame having a plate 30 which compresses the bar 22 thereby securely anchoring each of the legs 24, 26 firmly in place.

According to the present invention, the vertical support struts 24, 26 are fastened onto the side rails 18 by an improved rail clamp assembly 32. The clamp assembly 32 is configured to slide along the rails 18 and to be secured in a desired rail location in a manner to be described below. The support bar 22 is further stabilized by a pair of transverse struts 34, 36. Each transverse strut extends from one of the lower support legs upwardly for connection to the opposite side rail 18 by a clamp assembly 32.

The support bar 22 when stabilized by the struts 34, 36 and by the support legs 24, 26 serves as a stable platform onto which auxiliary support equipment such as a universal extremity positioner may be mounted. The suspension assembly 20 is further stabilized by a parallel brace 38 as illustrated in FIG. 3.

In the performance of various surgical procedures, particularly in orthopedic surgery, it is necessary to support various portions of the body including its extremities, such as arms and legs, in a suspended position while the procedure is performed. For example, a sling assembly may be attached to a universal extremity positioner and is adapted to support an arm or a leg of a patient at an elevated position during a surgical procedure. During such a procedure, it may be necessary to move a portion of the extremity or to apply biasing forces in one direction or another. The suspension assembly 20 makes this possible because of the stability provided by the vertical struts 24, 26, transverse struts 34, 36 and improved clamp assembly 32.

Figure 3:
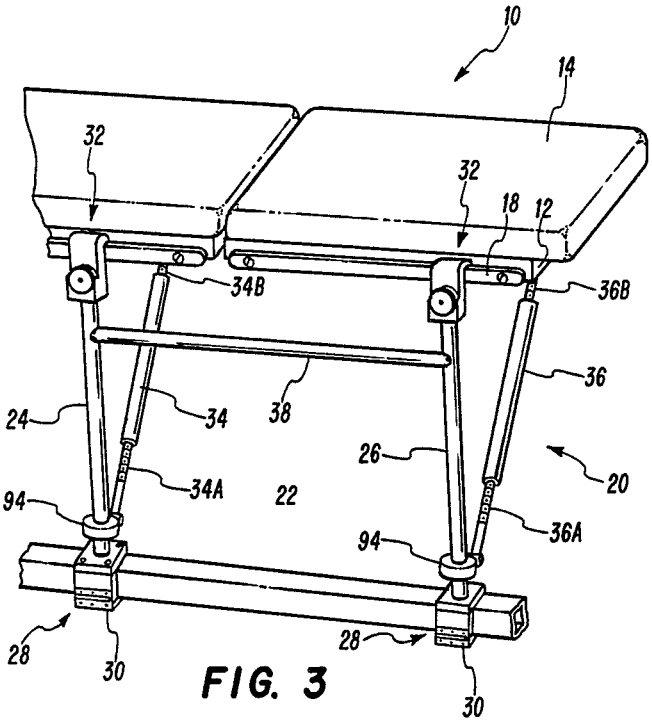
FIG. 3 is a prospective view of an alternate attachment arrangement.
Figure 5:
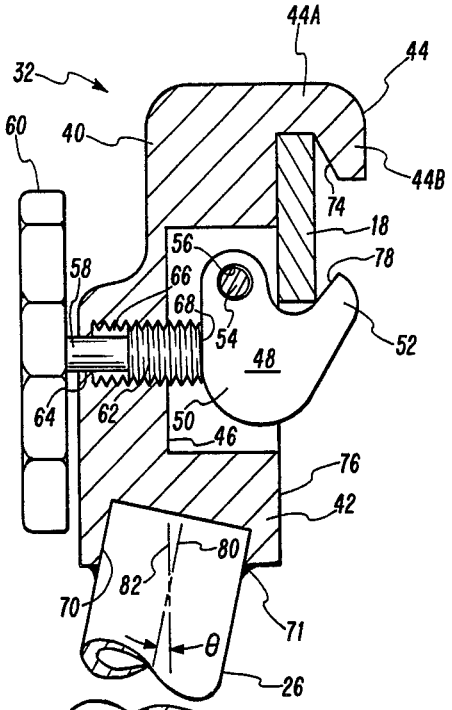
FIG. 5 is a sectional view taken along the lines V—V of FIG. 4.
Figure 5:
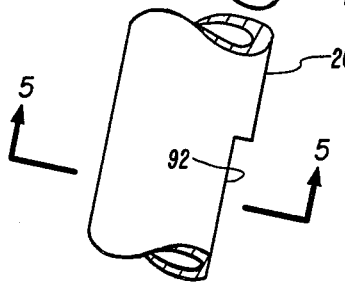
Figure 5:
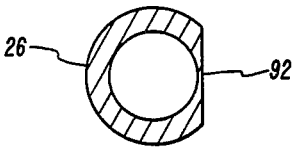
Figure 4:
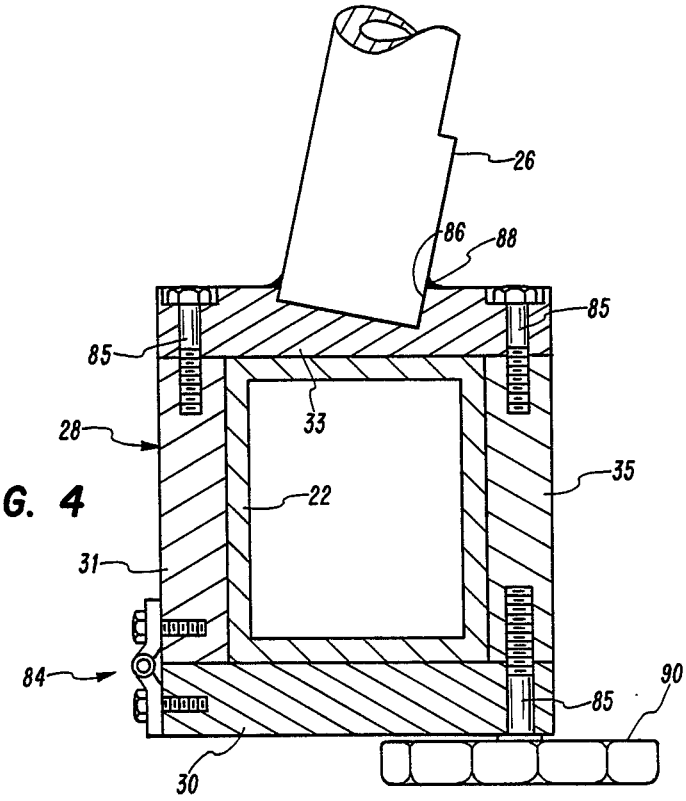
FIG. 4 is a sectional view of side rail clamp and suspension assembly which illustrates the relative positions of its various components when attached to a side rail.

Referring now to FIGS. 3 and 4, the improved clamp assembly 32 includes a clamp body 40 having an attachment portion 42 adapted for coupling engagement with surgical support apparatus such as the support leg 26 and, a fixed jaw member 44 for engaging the upper portion of the side rail 18. A cavity 46 is formed within the clamp body 40 of appropriate dimensions to receive a compression member 48. The chamber 46 is in the form of a rectangular slot which is centered within the clamp body portion 40.

The compression member 48 is provided with a cam portion 50 and a movable jaw portion 52. The compression member 48 is mounted for a free rotation on a pin 54 which is received within a bore 56 which extends transversely through the clamp body portion 40.

According to the foregoing arrangement, the movable jaw portion 52 of the compression member 48 is rotatable from a substantially open, retracted position to a clamped position as illustrated in FIG. 4. The compression member 48 is freely movable within the chamber 46 and can be manually retracted into the chamber to enlarge the distance between the fixed jaw 44 and the jaw 52 to allow the fixed jaw and the movable jaw to be fitted about the upper and lower edges of the side rail 18.

The compression member 48 is driven into engagement with the inside lower corner of the side rail 18 by a turn screw 58. Attached to the external portion of the turn screw 68 is a knurled knob 60, with the opposite end of the turn screw 58 being provided with an enlarged threaded portion 62. The turn screw 58 is received within a smooth bore 64 which intersects the body portion 40 and communicates with the cavity 46. The bore 64 is enlarged by a threaded bore 66 which is engaged by the threaded portion 62 of the turn screw. When the turn screw 58 is near the limit of its retraction within the threaded bore 66, the compression number 48 may be retracted within the cavity 46. In this configuration, the clamp assembly 32 can be quickly and easily mounted onto or removed from the side rail 18.

Referring again to FIG. 4, as the turn screw 58 is advanced through the threaded bore 66, an end portion 68 of the turn screw engages the cam portion 50 of the compression member 48 thereby causing the compression member 48 to rotate from its retracted position to an extended position in which its movable jaw portion 58 is forced into compressive engagement with the inside lower corner of the side rail 18. In this configuration, the side rail 18 is captured by the compressive force of engagement, thereby rigidly anchoring the clamp 32 at the desired location. The compressive force is transmitted by the turn screw 58 through the compression member 48, with the compression force being maintained by the reaction forces imparted by the threads of the threaded bore 66 and by the reaction forces which arise in response to engagement of the fixed jaw 44 with the upper portion of the side rail 18.

When removal of the clamp 32 is desired, the turn screw 58 is withdrawn from the cavity 46 through the threaded bore 66, thereby allowing the compression member 48 to be rotated to its retracted, open jaw position.

The coupling portion 42 of the clamp body 40 is provided with a cylindrical bore 70 for receiving a corresponding cylindrical portion of vertical support leg 26. The vertical support leg is secured onto the coupling portion 42 by a weld 71. The support leg can, if desired, be threaded for attachment to the coupling portion 42.

The jaw configuration illustrated in the embodiment of FIG. 4 is particularly well suited for anchoring engagement with a side rail having a rectangular configuration. The jaw 44 is articulated by a first flange portion 44A which projects at a right angle from the clamp body portion 40, and a second flange portion 44B which projects transversely to the first flange portion. The inside face of flange portion 44A is a planar surface 72. The inside face of flange 44B is an inclined planar surface 74. The surface 74 is inclined away from the clamp body portion and generally defines an obtuse angle with respect to planar surface 72.

According to this arrangement, the fixed jaw 54 will engage and lock side rails of various thicknesses. The inside face 76 of clamp body 40 is a planar surface which joins at a right angle with the inside face 72 of fixed jaw 44. The depth of jaw 44 is preferably large enough to accomodate the thickness of rail 18 as suggested by drawing FIG. 4. According to the foregoing arrangement, the exterior face of the side rail 18 is disposed in positive surface-to-surface engagement with the planar face 76 of clamp 32, while the upper edge portions of the side rail 18 are captured by the fixed jaw 44.

The force of compression is transmitted along line contact between the lower inside corner of side rail 18 and the inside face 78 of the movable jaw portion 52. The result of this engagement is that compression forces are being applied through the depth of side rail 18, as compression forces are developed through its vertical dimension. This compressive enagement along mutually orthogonal axes provides a superior clamping union between the clamp 32 and the side rail 18. According to this arrangement, the clamp assembly 32 is stabilized against rotation about side rail 18, and is also stabilized against sliding movement along side rail 18.

Accordingly, it will be seen that the improved clamping assembly 32 can be quickly and easily anchored onto the side rail of an operating table, and can be quickly released and removed from the side rail without disturbing the established positions of other surgical support devices anchored to the same side rail.

In the arrangement shown in FIGS. 3 and 4, the horizontal support bar 22 is supported in offset relation with respect to the side rail 18 by the vertical struts 24, 26. As can best be seen in FIG. 4, the longitudinal axis 80 of the strut 26 is inclined by a small angle theta ($\theta$) with respect to the vertical plane 82 which is parallel with the exterior face of side rail 18. The amount of lateral displacement of the horizontal support bar 22 is directly proportional to the magnitude of the inclination angle theta ($\theta$).

In the embodiment illustrated in FIGS. 3 and 4, the horizontal support bar 22 is coupled onto the lower end of the vertical struts 24, 26 by a box clamp 28. The box clamp 28 includes a movable bottom plate 30, a front plate 31, a top plate 33 and a rear plate 35. The movable bottom plate is pivotally attached to the front plate 31 by a hinge assembly 84. The top plate 33 is rigidly attached to the front plates 31, 35 by screw fasteners 85. The top plate 33 has a cylindrical bore 86 in which the lower cylindrical end of vertical strut 26 is received. The lower end of strut 26 is rigidly attached to top plate 33 by a weld 88.

When the movable plate 30 is pivoted to its open position, box clamp 28 can be fitted onto the top of the horizontal support bar 22. The bottom plate 30 is then rotated into the position shown in FIG. 4 and is secured by a screw fastener 85. As knob 90 is tightened, the lower support plate 30 is drawn into compressive engagement with the bottom side wall of the horizontal support bar 22. According to this arrangement, the suspension frame assembly 20 of FIG. 3 can be adapted for use with horizontal support bars 22 of various lengths to accomodate different operating procedures.

Figure 6:
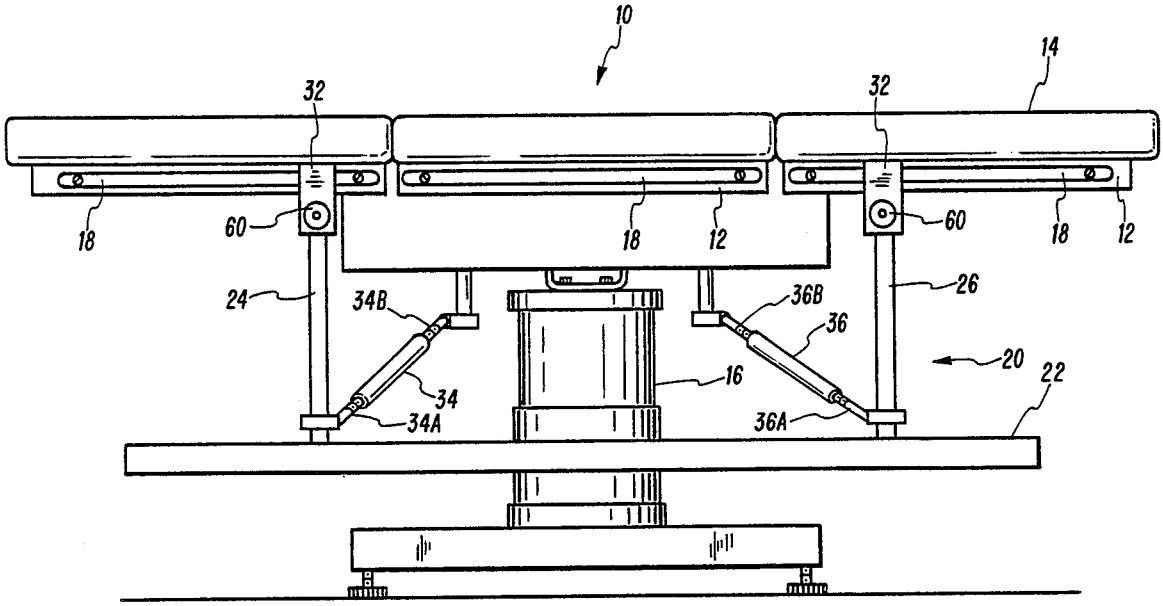
FIG. 6 is a view similar to FIG. 1 illustrating an alternate embodiment of the improved suspension frame and clamp assembly of the present invention.
Figure 7:
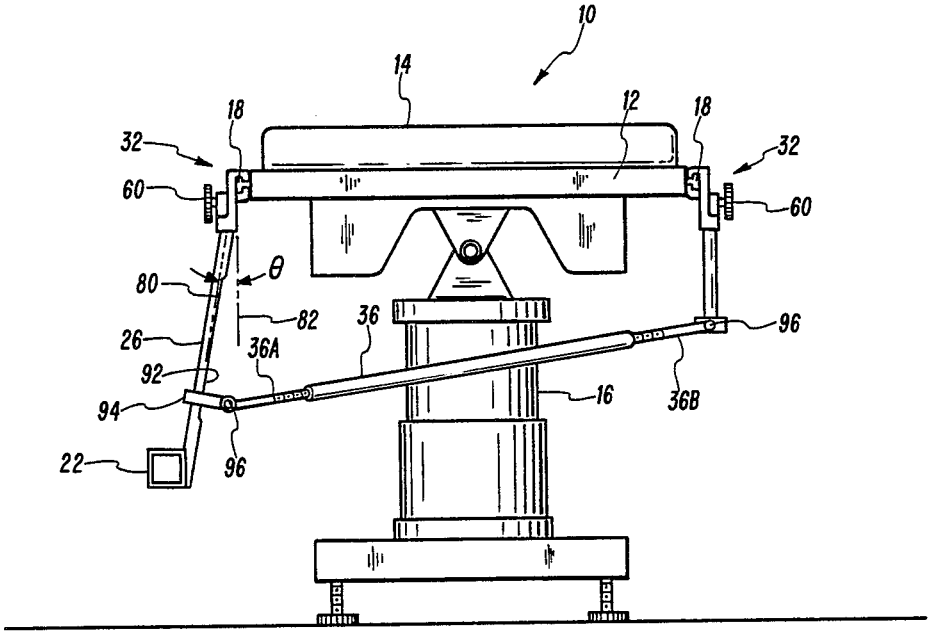
FIG. 7 is a view similar to FIG. 2 of the apparatus shown in FIG. 6.

Referring now to FIGS. 6 and 7, an alternate embodiment of the suspension frame assembly is disclosed. In this arrangement, the vertical support struts 24, 26 are rigidly attached at their lower end portions onto the horizontal support bar 22. Each vertical strut 24, 26 is provided with a flat 92 for indexing and preventing rotation of a strut clamp 94. As can best be seen in FIG. 7, the transverse strut 36 is adjustable and includes threaded end portions 36A, 36B which are movable in retraction and extension with respect to the cylindrical body portion of strut 36. The threaded end portion 36A is pivotally coupled to the strut clamp 94 by a pin 96. Likewise, the threaded end portion 36B is pivotally coupled by a pin 96 to a releasable clamp assembly 32 which is mounted onto the side rail 18 on the opposite side of the operating table. When the length of transverse strut assembly 36 is properly adjusted, it is slightly under tension, thereby producing a stable strut configuration.

Figure 8:
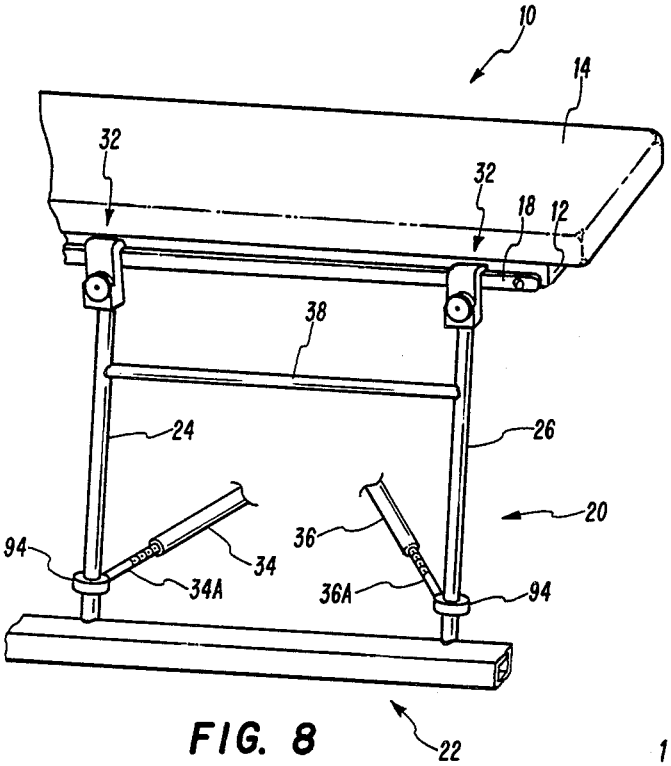
FIG. 8 is a prospective view which illustrates an alternate attachment arrangement for the apparatus shown in FIG. 7.
Figure 11:
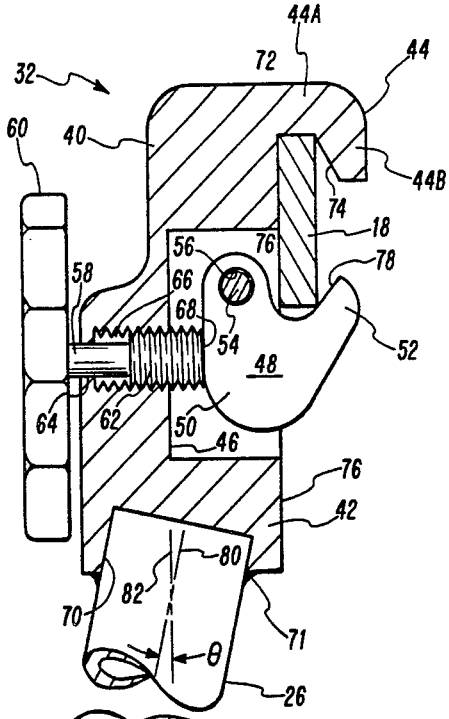
FIG. 11 is a sectional view of the strut shown in FIG. 9 taken along the lines XI—XI.
Figure 11:
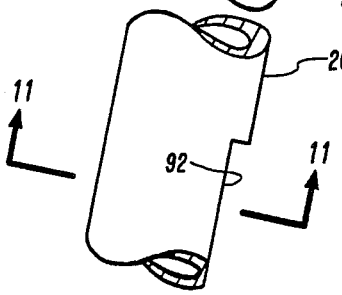
Figure 11:
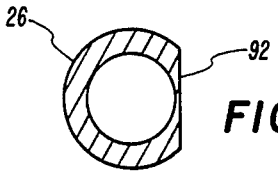
Figure 10:
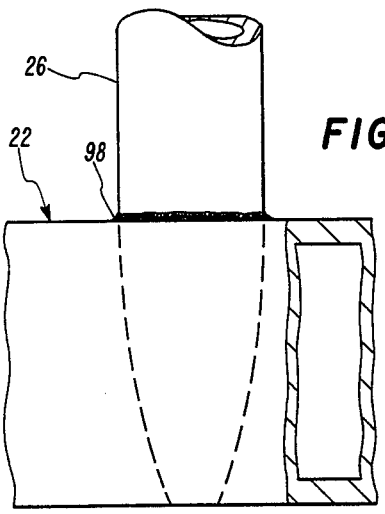
FIG. 10 is a front elevation view, partly in section, and partly broken away, of the strut and tube assembly shown in FIG. 9.
Figure 9:
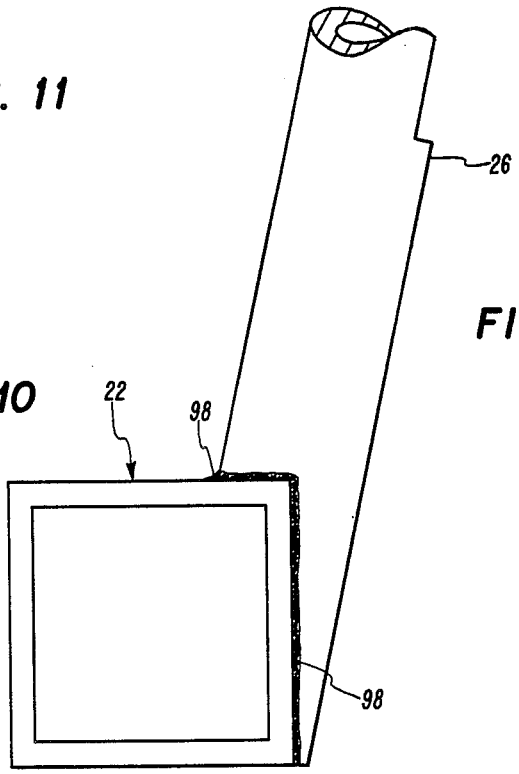
FIG. 9 is an elevation view, partly in section, of the alternate embodiment of the improved suspension frame and clamp assembly.

Referring now to FIGS. 8, 10 and 11, the lower end portion of each vertical support is cut away to conform with the inside top corner surface areas of the horizontal support bar 22. The union of the lower end portion of the support strut 26 with the inside top surface area of the horizontal support bar is secured by a weld 98. The vertical support struts are offset by the angle theta ($\theta$) as can best be seen in FIG. 9. Additionally, the vertical support struts 24, 26 are joined together by a parallel brace 38.

The foregoing disclosure and description of the invention are illustrated in explanatory thereof, and various changes in the size, shape and materials, as well as in the details of the illustrated construction may be made without departing from the spirit of the invention.

I claim:

1. A suspension assembly for use in combination with a table comprising, in combination:

a horizontal support bar;

first and second clamps each adapted for releasable attachment to said table;

first and second support legs, each support leg having a first end portion coupled to said support bar and having a second end portion attached to one of said clamps;

said first and second clamps each including a clamp body having an attachment portion adapted for coupling engagement with one of said support legs, a fixed jaw member projecting from said clamp body for engaging a portion of said table, and having a cavity for receiving a compression member;

a compression member received within the cavity in each clamp body and mounted thereon for movement away from said fixed jaw member to an open, retracted position allowing positioning of said fixed jaw member and said compression member about said table portion, and for movement from the retracted position to an extended position for engagement with said table portion;

means coupled to said clamp body for driving said compression member from its open, retracted position toward its extended position and into compressive engagement with said table portion; and, said compression member on each clamp body being mounted for pivotal movement to and from the extended and retracted positions, and said compression member comprising a cam portion for engaging said drive means and a movable jaw portion for engaging said table portion.

2. A suspension assembly as defined in claim 1, said fixed jaw member having a first flange portion projecting transversely with respect to said clamp body, and having a second flange portion attached to said first flange portion and projecting transversely thereto; and, wherein said clamp body has a planar surface for engaging the exterior side surface of said table portion, and said first flange portion having an inside planar surface joining said clamp body planar surface substantially at a right angle, and said second flange portion having an inside planar surface inclined with respect to the planar surface of said clamp body.

3. A suspension assembly as defined in claim 1, said horizontal support bar being rectangular in cross section, and including first and second box clamps coupling the first end portions of said first and second support legs onto said horizontal support bar, each box clamp having a movable plate for opening and closing said box clamp about said support bar.

4. A suspension assembly as defined in claim 3, including hinge means coupling said movable plate to said box clamp.

5. A suspension assembly as defined in claim 1, said first and second support legs projecting outwardly with respect to said first and second clamps, resepctively, whereby said horizontal support bar is held in a laterally offset position relative to said table when said suspension assembly is attached to said table.

6. A suspension assembly as defined in claim 1, including a support brace attached at its opposite ends to said support legs.

7. A suspension assembly as defined in claim 1, including first and second struts, each strut having a first end portion connected to one of said support legs, and having a second end portion adapted for connection with the laterally opposite side of said table relative to said table portion.

8. A suspension assembly as defined in claim 7, each strut having a threaded body portion and a threaded shaft portion received within said threaded body portion whereby the length of each strut can be varied.

9. A suspension system as defined in claim 1, each support leg being tubular and having a flat side surface along at least a portion of its length.

10. A suspension system as defined in claim 1, the second end portion of each support leg being cut away for conformal engagement with a portion of said horizontal support bar.

11. A clamp body as defined in claim 1, wherein each clamp body has a planar surface for engaging an exterior side surface of said table portion, and said jaw member having a planar inside surface for engaging an exterior side surface of said table portion.

12. A clamp as defined in claim 1, said clamp body having a threaded bore communicating with said locking cavity, and said driving means comprising a threaded shaft received in threaded engagement with said threaded bore, said shaft advancing into and withdrawing from said locking cavity in response to rotation and counterrotation, respectively, of said shaft.

* * * * *